US007818886B1

(12) United States Patent
Grindstaff et al.

(10) Patent No.: US 7,818,886 B1
(45) Date of Patent: Oct. 26, 2010

(54) ANTI-PINCH CHAINSAW BAR ASSEMBLY

(76) Inventors: Matthew Wade Grindstaff, 132 Kays La., Hollister, MO (US) 65672; Robert F. McDowell, 105 Briarcliff Dr. Dr., Branson, MO (US) 65616

( * ) Notice: Subject to any disclaimer, the term of this patent is extended or adjusted under 35 U.S.C. 154(b) by 638 days.

(21) Appl. No.: 11/740,039

(22) Filed: Apr. 25, 2007

(51) Int. Cl.
*B27B 17/02* (2006.01)
*B27B 17/04* (2006.01)

(52) U.S. Cl. ..... 30/383; 30/387

(58) Field of Classification Search ..... 30/383, 30/387, 381, 382, 384–386; 83/788, 820
See application file for complete search history.

(56) References Cited

U.S. PATENT DOCUMENTS

| | | | | |
|---|---|---|---|---|
| 2,774,395 | A | 12/1956 | Tweedie | |
| 3,949,475 | A | 4/1976 | Tokarz | |
| 4,534,112 | A | 8/1985 | Bass | |
| 4,765,062 | A | 8/1988 | Henriksson | |
| 4,825,553 | A | 5/1989 | Bruccheri | |
| 5,014,435 | A | 5/1991 | Date et al. | |
| 5,025,561 | A | 6/1991 | Sugihara et al. | |
| 5,035,058 | A | 7/1991 | Date et al. | |
| D341,309 | S | 11/1993 | Hammond | |
| 5,269,064 | A | 12/1993 | Greene et al. | |
| 5,537,751 | A | 7/1996 | Beerens | |
| 6,964,101 | B2 | 11/2005 | Graves et al. | |
| 7,631,430 | B2 * | 12/2009 | Chang | 30/381 |

* cited by examiner

*Primary Examiner*—Clark F. Dexter
(74) *Attorney, Agent, or Firm*—Erickson, Kernell, Derusseau & Kleypas, LLC

(57) ABSTRACT

An anti-pinch chainsaw bar assembly for enabling the extraction of chainsaw bars when bound or pinched during cutting includes rolling bearing members integrated into outer surfaces of the bar. The bearings are arranged in groups of at least two bearings in rolling contact with one another. At least one bearing in each group extends outwardly from each outer surface of the bar. The assembly preferably also includes wedge structures mounted on the distal end of the bar for spreading out the sides of a cut.

14 Claims, 6 Drawing Sheets

ANTI-PINCH CHAINSAW BAR ASSEMBLY

BACKGROUND OF THE INVENTION

1. Field of the Invention

The present invention relates generally to bars used to support the cutting chain of a chainsaw, and more specifically to an anti-pinch chainsaw bar assembly designed to facilitate extraction of a chainsaw bar bound or pinched during the cutting of timber.

2. Description of the Related Art

Chainsaws are typically used to fell timber and to trim branches from trees. Afterwards, the trunk and branches are typically cut into smaller sections for ease of handling and use as firewood. While cutting timber or other material with a chainsaw, care should be taken to avoid pinching or binding the chainsaw bar within the gap formed by the cut. Nevertheless, binding may occur due to unexpected material movement and, in particular, may be difficult to avoid when cutting limb wood which is subject to twisting, due to wind and to movement under force of gravity, including rotational forces exerted upon the limb from associated branches. In addition, limb wood is known to contain internal forces that may be released as the limb is cut causing the gap to close upon the bar.

Since the bar generally has opposing flat sides that each typically present a relatively large surface area, the bar may be quite difficult to remove from the gap when binding occurs. To remove the bar, it may be necessary to reposition the material being cut or to pry the gap open using separating mechanisms. While these solutions may be time-consuming but useful when cutting timber to length on the ground, they may not be practical when binding occurs within a large branch still attached to the trunk and suspended high above ground.

It would be advantageous, therefore, to have a chainsaw with a bar adapted to be more readily withdrawn from material being cut even when pinched or bound.

SUMMARY OF THE INVENTION

The present invention is an anti-pinch chainsaw bar assembly for enabling the extraction of a chainsaw from a cut when the bar is pinched or bound. In a preferred embodiment, the bar is a laminate structure comprising a pair of outer plates and an inner plate sandwiched therebetween. Formed between the inner and outer plates are a plurality of pockets which each receive a respective rotatable cylindrical roller bearing. Each roller bearing extends outwardly from an outer face of the respective outer plate to present a bearing surface to the material being cut. The roller bearings are arranged in bearing groups of at least two, and preferably three, cylindrical roller bearings wherein each roller bearing in a bearing group is in rolling contact with at least one other bearing in the group such that rotation of a first roller bearing in the bearing group facilitates rotation in a second, and preferably a third roller bearing. The roller bearings in each bearing group are arranged such that the bearing surface of at least one roller bearing in each bearing group is presented on each outer plate of the bar. Typically, the bearing groups are arranged along the bar in a pattern that optimizes the withdrawal of the bar from the gap in a rearward direction (towards the user) without excessively compromising bar stiffness and strength.

DETAILED DESCRIPTION OF THE PREFERRED EMBODIMENTS

Figure 2:
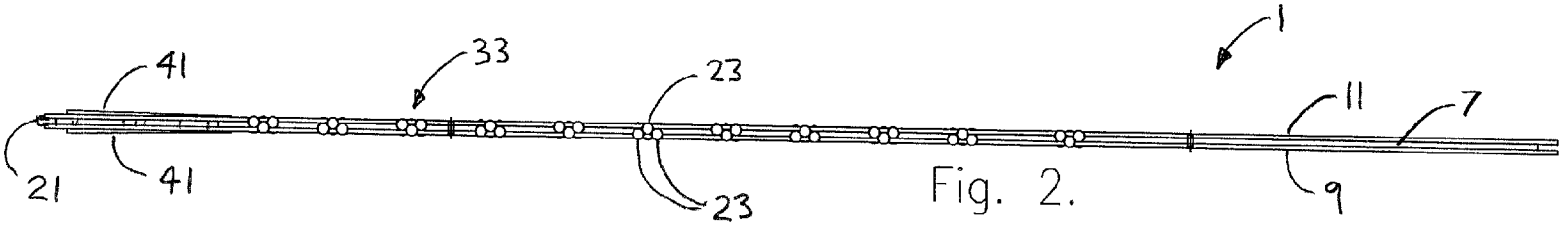
FIG. 2 is a cross-sectional view of the chainsaw bar assembly taken generally along line 2-2 in FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 1:
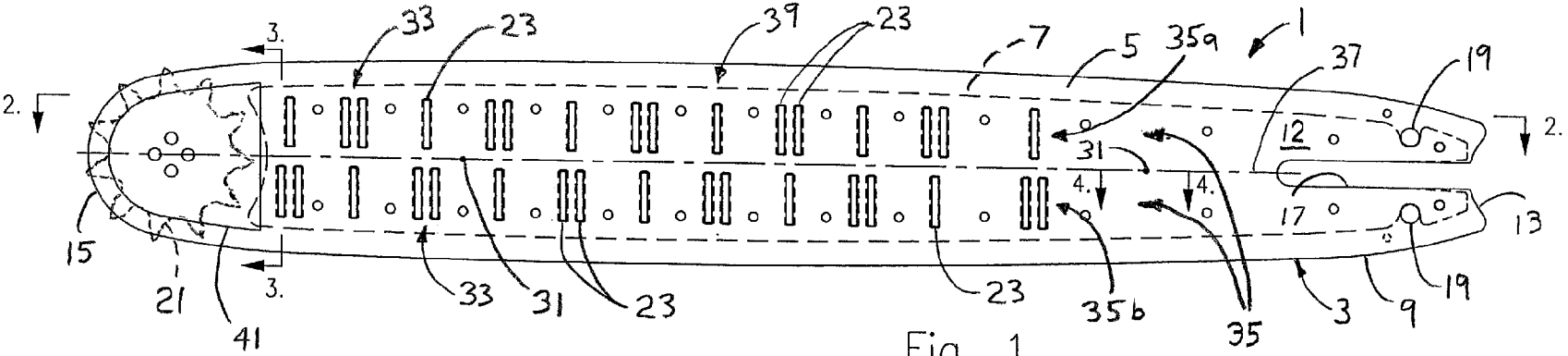
FIG. 1 is a left side elevational view of a chainsaw bar assembly embodying the present invention.

Referring to the drawings in more detail, and in particular to FIGS. 1 and 2, the reference number 1 generally designates an anti-pinch chainsaw bar assembly 1 including an elongate bar 3 having a peripheral slot 5 for receiving and guiding a saw chain (not shown) around the bar 3. The bar 3 is a laminate structure formed by sandwiching an inner plate 7 between first and second opposing outer plates 9 and 11, respectively. Each outer plate 9 and 11 includes a respective outer surface 12 which also comprises an outer surface of the bar 3. The bar 3 has a mounting end 13 for connection to a chainsaw drive assembly (not shown) and a nose or distal end 15. The mounting end 13 may include a slot 17 and holes 19 for alignment and adjustable attachment to the drive assembly. The chain forms a closed loop that encircles the perimeter of the bar 3 and includes inwardly extending drivers which extend into the peripheral slot 5. The chain extends past the mounting end 13 of the bar 3 to engage a drive sprocket (not shown) powered by a motor of the drive assembly. The distal end 15 of the bar 3 typically includes a nose sprocket 21 rotatably mounted between the outer plates 9 and 11 and positioned to be drivingly engaged by the drivers of the saw chain.

Figure 3:
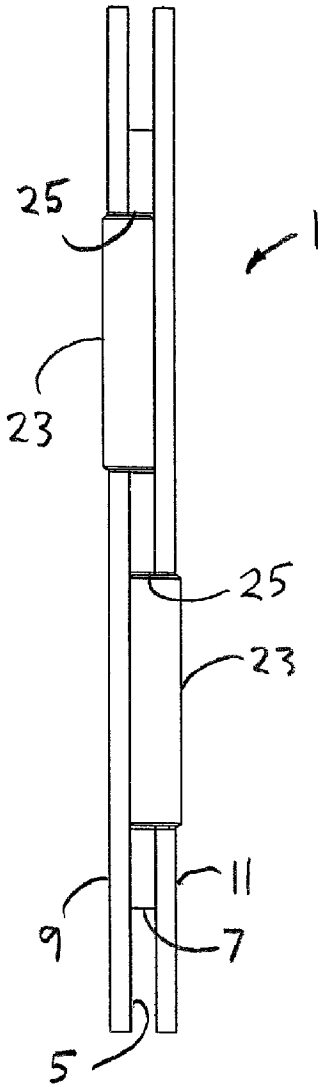
FIG. 3 is a cross-sectional view of the chainsaw bar assembly taken generally along line 3-3 in FIG. 1.
Figure 4:
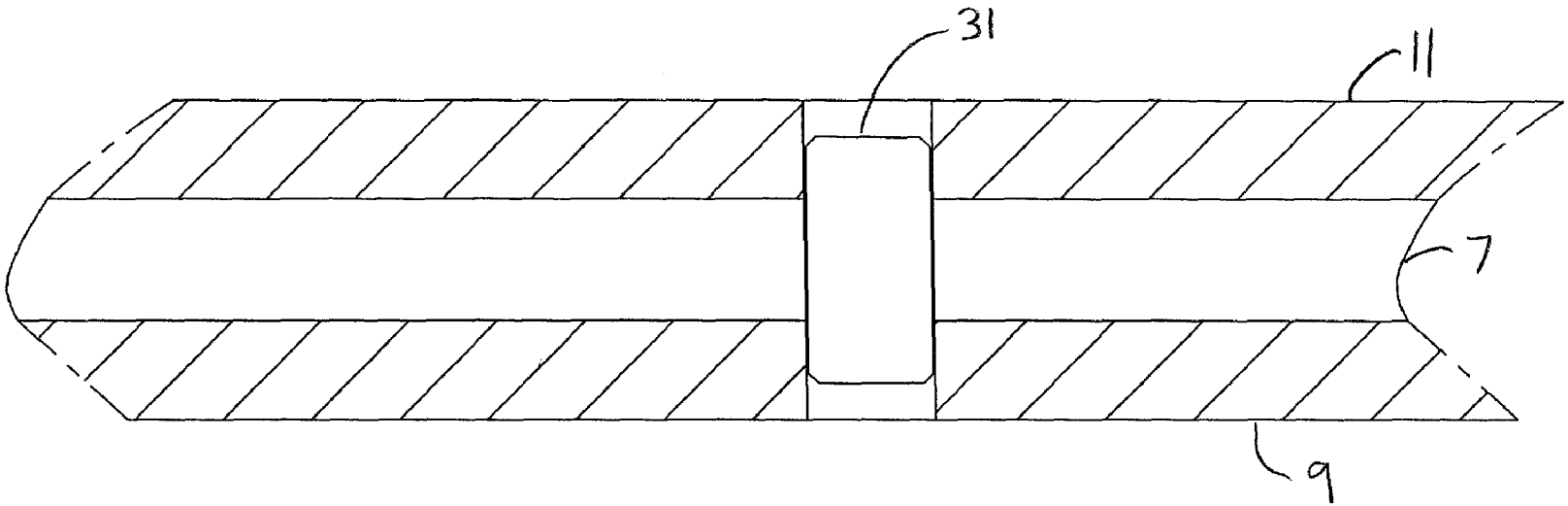
FIG. 4 is a cross-sectional view of the chainsaw bar assembly taken generally along line 4-4 in FIG. 1.
Figure 5:
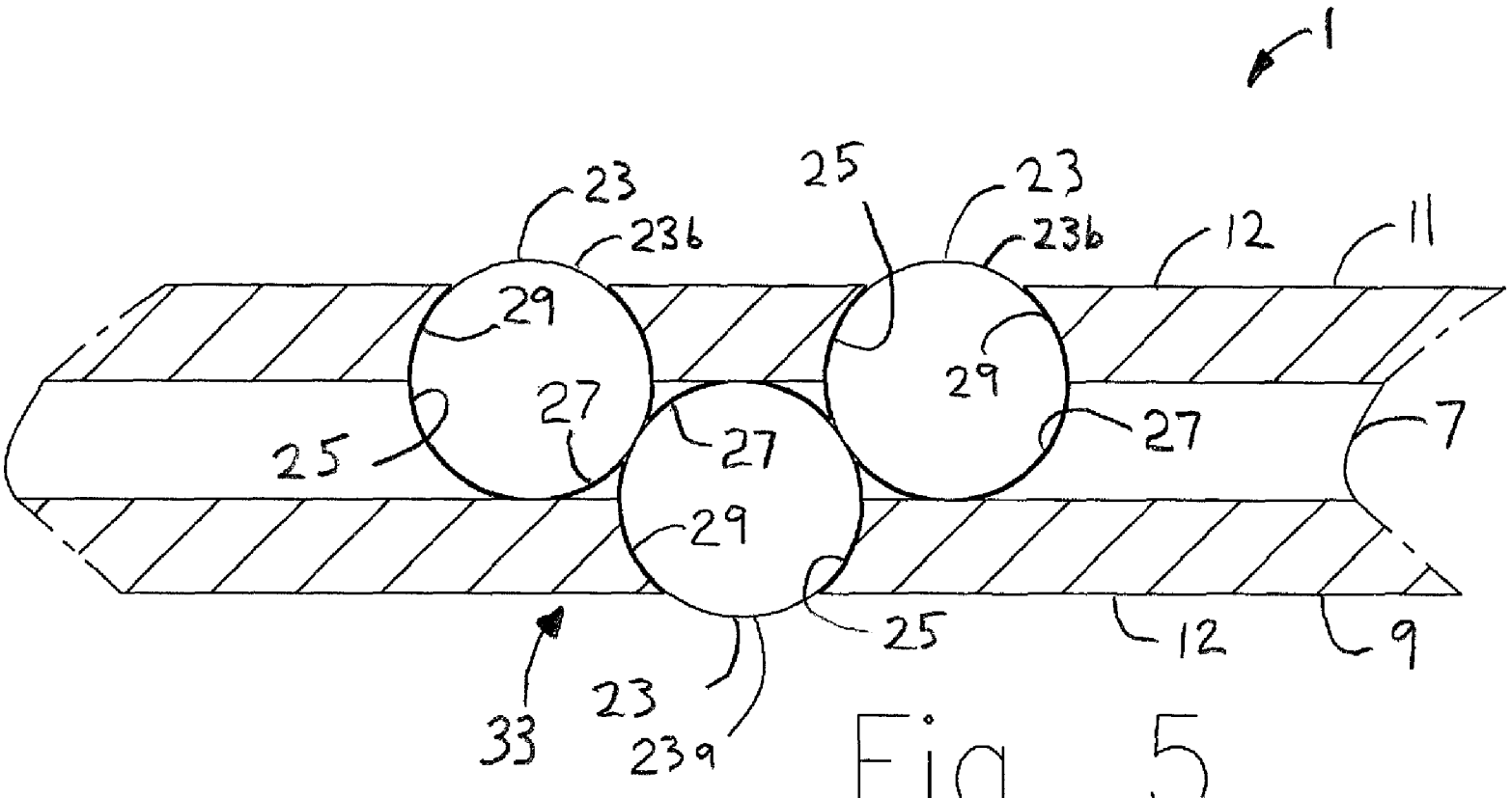
FIG. 5 is an enlarged fragmentary cross-sectional view similar to FIG. 2 showing a single bearing group.

As best seen in FIGS. 3 and 5, the bar assembly 1 further includes a plurality of roller bearings 23 set into pockets 25 in the bar 3. Referring in particular to FIG. 5, each pocket 25 includes a semi-cylindrical trough 27 formed in the inner plate 7 and a respective aperture 29 formed in one of the outer plates 9 or 11. Each trough 27 is sized and shaped to rotatably receive the respective roller bearing 23 and to seat approximately one longitudinal half of the roller bearing 23 therein. Each aperture 29 is also generally semi-cylindrical in shape, but extends through the outer plate 9 or 11 so as to be open to the outer surface 12 of the respective outer plate. A portion of the roller bearing 23 positioned in the pocket 25 thus extends outwardly from the respective outer surface 12 to present a rolling bearing surface to the material being cut. Less than half of each roller bearing 23 extends out of the respective pocket 25 through the aperture 29, thus the roller bearings 23 are captured between the inner plate 7 and the respective outer plate 9 or 11 so that they cannot be dislodged from the bar 3. As best seen in FIGS. 1 and 4, the outer plates 9 and 11 are attached to the inner plate 7 using dowel pins 31 to insure proper alignment of the apertures 29 with the respective troughs 27 to prevent binding of the rollers 23 within the pockets 25.

Referring to FIGS. 1 and 5, the roller bearings 23 and pockets 25 are organized into bearing groups 33. The bearing groups 33 each include at least two roller bearings 23 and preferably at least three roller bearings 23 (three shown). Within each bearing group 33, at least one roller bearing 23 extends outwardly from each of the opposed outer surfaces 12 of the outer plates 9 and 11. The troughs 27 of the pockets 25 within each bearing group 33 intersect such that the respective roller bearings 23 are each in rolling contact with at least one other roller bearing 23 within the same bearing group 33. In an embodiment with three roller bearings 23 in each bearing group 33, a center roller bearing 23*a* will be in rolling contact with two outside roller bearings 23*b*. Rotation of any one of the roller bearings 23 in a bearing group 33 thus facilitates rotation of at least one other roller bearing 23 in the same bearing group 33.

The bearing groups 33 are preferably arranged along the bar 3 in a pattern that optimizes the withdrawal of the bar from the gap in a rearward direction (towards the user). For example, the groups are shown in FIG. 1 as being arranged in two parallel longitudinal rows 35, including an upper row 35*a* positioned above a longitudinal centerline 37 of the bar 3 and a lower row 35*b* positioned below the longitudinal centerline 37. Each roller bearing 23 is oriented generally perpendicular to the longitudinal centerline 37.

The bearing groups 33 are shown as being groups of three roller bearings 23 and the orientation of the bearing groups 33 is alternated such that the center bearings 23*a* in adjacent groups 33 in each row 35 extend outward from opposite outer surfaces 12 of the bar 3. In this arrangement, the outside roller bearings 23*b* in adjacent groups 33 also extend outward from opposite outer surfaces 12 of the bar 3. The rows 35 are also shown as having bearing groups 33 which are aligned in vertical pairs 39 across the longitudinal centerline. In each vertical pair 39, one bearing group 33 has its respective center bearing 23*a* extending outward from one outer surface 12 of the bar 3 and the other bearing group 33 has its respective center bearing 23*a* extending outward from the opposite outer surface 12. Consequently, each vertical pair 39 has one bearing group 33 with its outside roller bearings 23*b* extending outwardly from each of the outer surfaces 12 of the bar 3.

Figure 6:
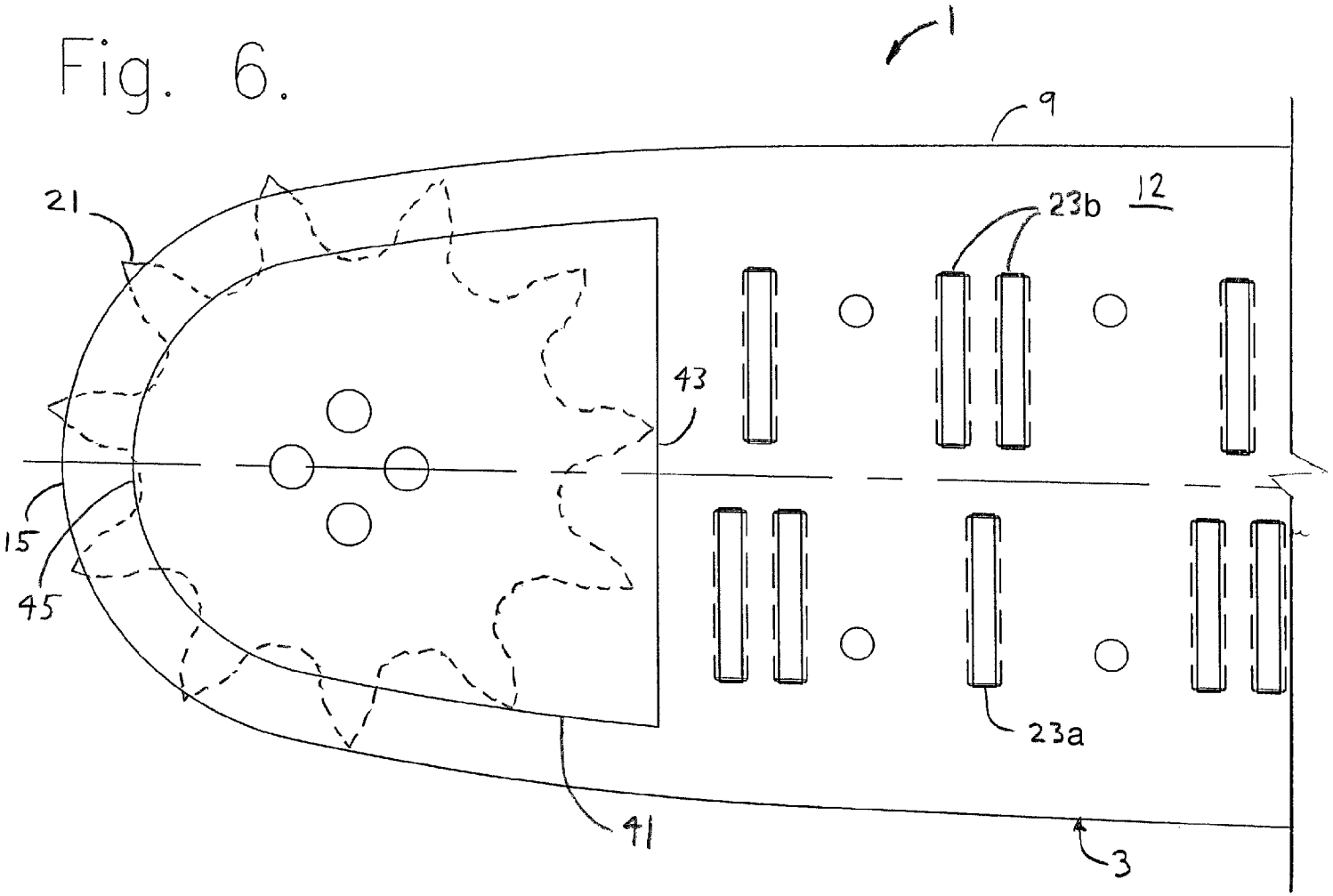
FIG. 6 is an enlarged fragmentary left side elevational view similar to FIG. 1 showing a wedge structure which forms a part of the present invention.
Figure 7:
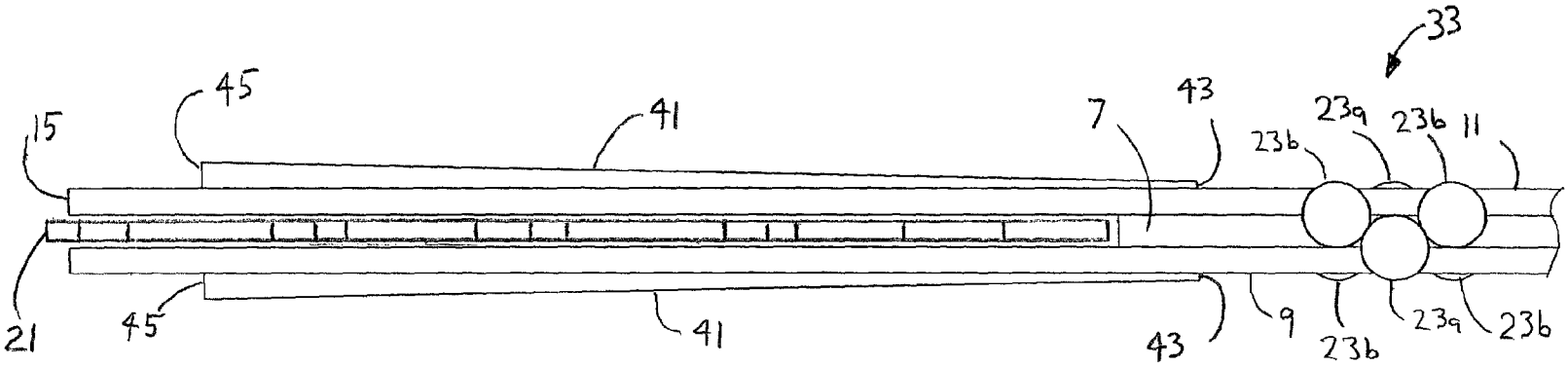
FIG. 7 is an enlarged fragmentary cross-sectional view similar to FIG. 2 showing a wedge structure which forms a part of the present invention.

In another aspect of the present invention, best seen in FIGS. 6 and 7, the bar 3 includes a pair of wedge structures 41 positioned on the outer surfaces 12 of the outer plates 9 and 11 proximate the distal end 15. Each wedge structure 41 has a thin end 43 and a thicker end 45. The wedge structures are oriented with their thicker ends 45 nearest the distal end 15 of the bar 3. When the bar 3 is pinched in a cut and the bar 3 is pulled toward the operator, the wedge structures bear against the edges of the cut and act to spread the sides of the cut apart and thereby assist in extracting the bar. The wedge structures 41 may be integrally formed with the outer plates 9 and 11, or formed separately and attached to the plates 9 and 11, such as by welding or by the use of fasteners (not shown).

It is to be understood that while certain forms of the present invention have been illustrated and described herein, it is not to be limited to the specific forms or arrangement of parts described and shown. For example, it is foreseen that the bearing groups 33 may each contain two, three, or more roller bearings 23. All that is required is that there be at least two roller bearings 23 in at least one bearing group 33, that the roller bearings 23 in the bearing group 33 be in rolling contact with one another, and that at least one respective roller bearing 23 in the group 33 extend outwardly past each outer surface 12 of the bar 3.

Furthermore, it is to be understood that the pattern in which the bearing groups 33 are arranged on the bar 3 may be modified. For example, there may be more or less than two rows 35 of bearing groups 33, or the bearing groups may not be arranged in parallel rows at all. It is also to be understood that bearing groups 33 need not be vertically aligned. It is also foreseen that the individual roller bearings 23 may not be oriented perpendicular to the centerline of the bar 3; for example, a herringbone pattern (not shown) of bearings is foreseen. In addition, it is foreseen that bearing groups or assemblies could be incorporated into the structure forming the wedge.

It is also to be understood that the bar 3 may be formed of more or less than the three plates described above. For example the bar 3 may be formed of only two plates with a space maintained therebetween, or a laminate of more than three plates may be employed. In an application using only two plates, spacers (not shown) may be used to maintain the two plates in spaced relation to one another.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. An anti-pinch chainsaw bar assembly, comprising:

a) an elongate bar having a perimeter, opposed first and second outer surfaces, a mounting end and a distal end, at least a portion of said perimeter being adapted for guiding a saw chain around said bar, and b) a group of at least two roller bearings set into said bar wherein at least a first one of said roller bearings in said group presents a bearing surface outwardly past said first outer surface of said bar and at least a second one of said bearings in said group presents a bearing surface outwardly past said second outer surface of said bar, and wherein each of said bearings in said group is in rolling contact with at least one other bearing in said group.

2. The anti-pinch chainsaw bar assembly as in claim 1 wherein said bar is formed of three plates including an inner plate sandwiched between first and second outer plates.

3. The anti-pinch chainsaw bar assembly as in claim 2 wherein each said roller bearing is set into a pocket formed between said inner plate and one of said outer plates.

4. The anti-pinch chainsaw bar assembly as in claim 3 wherein each said pocket includes a trough formed in said inner plate and an aperture formed in the respective one of said outer plates.

5. The guide bar as in claim 4 wherein each said bearing member is captured between said inner plate and the respective outer plate.

6. The anti-pinch chainsaw bar assembly as in claim 1 wherein there are three roller bearings in each said group, including a center roller bearing in rolling contact with first and second outer roller bearings.

7. The anti-pinch chainsaw bar assembly as in claim 6 wherein said center roller bearing presents a bearing surface outwardly past said first outer surface of said bar and said outer bearings each present a bearing surface outwardly past said second outer surface of said bar.

8. The anti-pinch chainsaw bar assembly as in claim 6 wherein said group of roller bearings comprises a first group of roller bearings and said assembly further includes a second group of three roller bearings set into said bar and including a center roller bearing extending outwardly past said second outer surface of said bar, said center roller bearing being in rolling contact with first and second outer roller bearings, each of said outer roller bearings presenting a bearing surface outwardly past said first outer surface of said bar.

9. The anti-pinch chainsaw bar assembly as in claim 1 wherein there are a plurality of said groups set into said bar and arranged along said bar to facilitate removal of said bar from a cut in a rearward longitudinal direction toward said mounting end of said bar.

10. The anti-pinch chainsaw bar assembly as in claim 1 and further including a pair of wedge structures mounted on said outer surfaces of said bar proximate said distal end thereof, each of said wedge structures having a thin end oriented toward said mounting end of said bar and a thicker end oriented toward said distal end of said bar.

11. An anti-pinch chainsaw bar assembly, comprising:

a) an elongate bar comprising opposing outer plates and a slot formed around the periphery of said bar for receiving and guiding a saw chain; and b) a group of roller bearings including at least a first cylindrical roller bearing and a second cylindrical roller bearing mounted in said elongate bar, said first and second roller bearings in abutting rolling relationship with each other along respective peripheral surfaces thereof, a portion of each said first and second roller bearing extending outwardly from a respective outer surface of said opposing outer plates through openings formed therein such that rotation of said first cylindrical roller bearing facilitates rotation of said second cylindrical roller bearing.

12. The anti-pinch chainsaw bar assembly of claim 11, and further comprising a third roller bearing in each said group.

13. The anti-pinch chainsaw bar assembly of claim 11, wherein there are a plurality of said groups presenting alternating numbers of bearing surfaces on each of said opposing outer plates along the plane of said elongate bar.

14. The anti-pinch chainsaw bar assembly of claim 11, and further including an inner plate sandwiched between said opposing outer plates, said inner plate including semi-cylindrical pockets retaining said roller bearings.

* * * * *